US011871845B2

(12) United States Patent
Tracy et al.

(10) Patent No.: US 11,871,845 B2
(45) Date of Patent: Jan. 16, 2024

(54) SHELF HAVING A BI-DIRECTIONAL SLIDE AND TILT MECHANISM

(71) Applicant: GM Global Technology Operations LLC, Detroit, MI (US)

(72) Inventors: Adam Tracy, Irvine, CA (US); Emanuel Magallon, Chicago, IL (US); Ryan Braunstein, San Carlos, CA (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 17/711,302

(22) Filed: Apr. 1, 2022

(65) Prior Publication Data

US 2023/0309694 A1 Oct. 5, 2023

(51) Int. Cl.
*A47B 88/403* (2017.01)
*A47B 46/00* (2006.01)
(Continued)

(52) U.S. Cl.
CPC ..... *A47B 88/403* (2017.01); *A47B 46/005* (2013.01); *A47B 88/402* (2017.01);
(Continued)

(58) Field of Classification Search
CPC . A47B 88/0455; A47B 88/0451; A47B 88/06; A47B 88/18; A47B 88/402; A47B 88/403; A47B 88/417; A47B 88/48; A47B 88/60; A47B 2088/0403; A47B 57/04; A47B 46/00; A47B 46/005; A47B 67/04; A47B 2031/003; A47F 5/0081; A47F 5/0093
See application file for complete search history.

(56) References Cited

U.S. PATENT DOCUMENTS 2,953,254 A * 9/1960 Schnelle ..... B42F 15/0094 211/46
3,439,967 A * 4/1969 Taylor ..... A47B 88/48 312/246
(Continued)

FOREIGN PATENT DOCUMENTS

DE 1654557 A1 * 2/1971 ..... A47B 88/57
DE 2341001 A1 * 2/1975 ..... A47B 88/48
(Continued)

*Primary Examiner* — Andrew M Roersma
(74) *Attorney, Agent, or Firm* — CANTOR COLBURN LLP

(57) ABSTRACT

A shelving system including a cabinet including a product receiving zone. The product receiving zone includes a first end, a second end, a first side and a second side. A shelf member is arranged between the first side and the second side. The shelf member includes a first side portion and a second side portion. One of the first side portion and the second side portion includes a first shelf support and a second shelf support. A bi-directional slide and tilt system is mounted to one of first side and the second side of the product receiving zone. The bi-directional slide and tilt system includes a first portion receptive of the first shelf support and a second portion receptive of the second shelf support. The first portion and the second portion facilitate sliding and tilting of the shelf relative to the product receiving zone.

20 Claims, 13 Drawing Sheets

(51) Int. Cl.

| | |
|---|---|
| ***A47B 88/423*** | (2017.01) |
| ***A47B 88/40*** | (2017.01) |
| ***A47B 88/48*** | (2017.01) |
| ***A47B 88/60*** | (2017.01) |

(52) U.S. Cl.
CPC ..... *A47B 88/423* (2017.01); *A47B 88/48* (2017.01); *A47B 88/60* (2017.01)

(56) References Cited

U.S. PATENT DOCUMENTS

| | | | | | |
|---|---|---|---|---|---|
| 4,314,734 | A * | 2/1982 | Grunert | A47B 88/48 | 312/333 |
| 5,119,942 | A * | 6/1992 | McCullars | A47F 5/0025 | 211/151 |
| 5,472,270 | A * | 12/1995 | Czarnecky | A47B 88/402 | 312/265.6 |
| 8,267,261 | B2 * | 9/2012 | Vanderhoek | A47F 5/0081 | 211/187 |
| 10,959,520 | B2 * | 3/2021 | Filipowicz | A47B 88/60 | |
| 11,051,613 | B1 * | 7/2021 | Gilbreath | E05B 65/46 | |

FOREIGN PATENT DOCUMENTS

| | | | | | |
|---|---|---|---|---|---|
| DE | 2840090 | A1 * | 3/1980 | A47B 88/0451 | |
| DE | 29702585 | U1 * | 5/1997 | A47B 88/16 | |
| DE | 202005002443 | U1 * | 6/2005 | A47B 57/04 | |
| GB | 423887 | A * | 2/1935 | A47B 88/48 | |
| GB | 849546 | A * | 9/1960 | | |
| GB | 2242350 | A * | 10/1991 | A47B 88/0451 | |

* cited by examiner

SHELF HAVING A BI-DIRECTIONAL SLIDE AND TILT MECHANISM

INTRODUCTION

The subject disclosure relates to the art of shelving systems and, more particularly, to a shelf having a bi-directional slide and tilt mechanism.

Various shelf systems include shelves that may slide out from a housing. In some cases, shelves may be able to tilt downwardly to facilitate access to articles supported thereon. Often times, an upper most, or upper shelves are able to tilt downward to provide enhanced access. The shelf may slide from an end stop outwardly and, at a certain point, may be tilted downward. The downward tilting is not achieved through any particular mechanism but rather facilitated by a spacing between shelves and a height of a storage unit. That is, the shelf itself may be tilted downward when withdrawn a certain distance from a housing.

Generally, the storage unit or shelf includes a rear stop that prevents insertion beyond a certain point. This prevents, for example, the storage unit or shelf from falling out of a rear portion of the housing. Further, the use of a stop allows the housing to include a single locking mechanism that prevents unauthorized withdrawal of the storage unit or shelf. Many current shelving systems include a loading end and a removal end.

More specifically, the shelf may slide in a first direction to be loaded and in a second direction to be unloaded. Loading and unloading upper shelves can be difficult for certain individuals. Simply allowing a shelf to hang downward to be loaded or unloaded can lead to accidents such as a shelf falling from a cabinet. Accordingly, it is desirable to provide a shelving system including shelves, particularly upper most shelves, that have a bi-directional sliding and tilting mechanism to enhance access to products.

SUMMARY

Disclosed, in accordance with a non-limiting example, is a shelving system including a cabinet including a product receiving zone. The product receiving zone includes a first end, a second end that is opposite the first end, a first side and a second side that is opposite the first side. The first side and the second side extends between the first end and the second end. A shelf member is arranged between the first side and the second side. The shelf member includes a first side portion and a second side portion. One of the first side portion and the second side portion includes a first shelf support and a second shelf support. A bi-directional slide and tilt system is mounted to one of first side and the second side of the product receiving zone. The bi-directional slide and tilt system includes a first portion receptive of the first shelf support and a second portion receptive of the second shelf support. The first portion and the second portion facilitate sliding and tilting of the shelf relative to the product receiving zone.

In addition to one or more of the features described above or below, or as an alternative, further embodiments could include wherein the first portion includes a first track extending at a first angle relative to the one of the first side and the second side and the second portion includes a second track that extends at a second angle relative to the one of the first side and the second side, the second angle being distinct from the first angle.

In addition to one or more of the features described above or below, or as an alternative, further embodiments could include wherein the first track includes a first section extending toward the first end and a second section extending toward the second end, and the second track includes a third section extending toward the first end and a fourth section extending toward the second end.

In addition to one or more of the features described above or below, or as an alternative, further embodiments could include a switch member mounted to the one of the first side and the second side, the switch member being selectively positioned in a first configuration connecting the first section of the first track with the fourth section of the second track and a second configuration connecting the second section of the first track with the third section of the second track.

In addition to one or more of the features described above or below, or as an alternative, further embodiments could include an activation system that selectively shifts the switch member between the first configuration and the second configuration.

In addition to one or more of the features described above or below, or as an alternative, further embodiments could include wherein the activation system includes a first portion mounted on the shelf member and a second portion mounted on the switch member.

In addition to one or more of the features described above or below, or as an alternative, further embodiments could include wherein the first portion of the activation system includes a member projecting outwardly of the one of the first side portion and the second side portion between the first shelf support and the second shelf support.

In addition to one or more of the features described above or below, or as an alternative, further embodiments could include wherein the member includes a first magnet, and the second portion of the activation system includes a second magnet.

In addition to one or more of the features described above or below, or as an alternative, further embodiments could include wherein the second magnet includes a first magnet element arranged at a first end section of the switch member and a second magnet element arranged at a second end section of the switch member.

In addition to one or more of the features described above or below, or as an alternative, further embodiments could include wherein the second portion of the activation system includes a first cam surface and a second cam surface.

In addition to one or more of the features described above or below, or as an alternative, further embodiments could include wherein the first cam surface includes a first cam angle and the second cam surface includes a second cam angle.

In addition to one or more of the features described above or below, or as an alternative, further embodiments could include wherein the first cam surface and the second cam surface meet at a point created by the first angle and the second angle.

In addition to one or more of the features described above or below, or as an alternative, further embodiments could include wherein the activation mechanism includes a first portion mounted to the one of the first side and the second side and operatively connected to the switch member and a second portion that extends between the first end and the second end at the one of the first side and the second side.

In addition to one or more of the features described above or below, or as an alternative, further embodiments could include wherein the first portion is a first gear and the second portion is a second gear.

In addition to one or more of the features described above or below, or as an alternative, further embodiments could include wherein the second gear is a worm gear.

In addition to one or more of the features described above or below, or as an alternative, further embodiments could include an angle control bar extending between the first end and the second end below the shelf member.

In addition to one or more of the features described above or below, or as an alternative, further embodiments could include wherein the shelf member is supported by only one of first shelf support and the second shelf support and the angle control bar when in a tilted configuration.

In addition to one or more of the features described above or below, or as an alternative, further embodiments could include wherein the angle control member limits tilting of the shelf member to a particular angle.

In addition to one or more of the features described above or below, or as an alternative, further embodiments could include wherein the second portion of the bi-directional slide and tilt system includes an end stop.

In addition to one or more of the features described above or below, or as an alternative, further embodiments could include wherein the second portion of the bi-directional slide and tilt system includes a first track element and a second track element spaced from the first track element, the one of the first shelf support and the second shelf support passing through the second portion is constrained between the first track element and the second track element.

The above features and advantages, and other features and advantages of the disclosure are readily apparent from the following detailed description when taken in connection with the accompanying drawings.

BRIEF DESCRIPTION OF THE DRAWINGS

Other features, advantages and details appear, by way of example only, in the following detailed description, the detailed description referring to the drawings in which.

DETAILED DESCRIPTION

Figure 1:
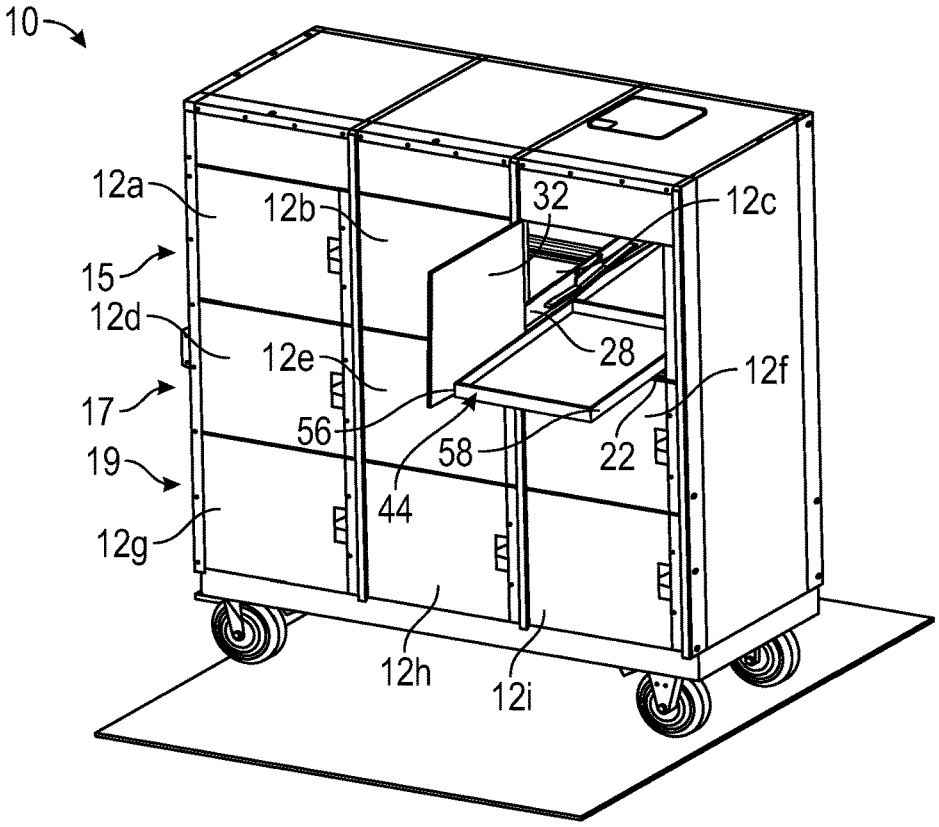
FIG. 1 is a front perspective view of a cabinet including a shelving system having a bi-directional slide and tilt mechanism, in accordance with a non-limiting example.

The following description is merely exemplary in nature and is not intended to limit the present disclosure, its application or uses. It should be understood that throughout the drawings, corresponding reference numerals indicate like or corresponding parts and features.

Figure 2:
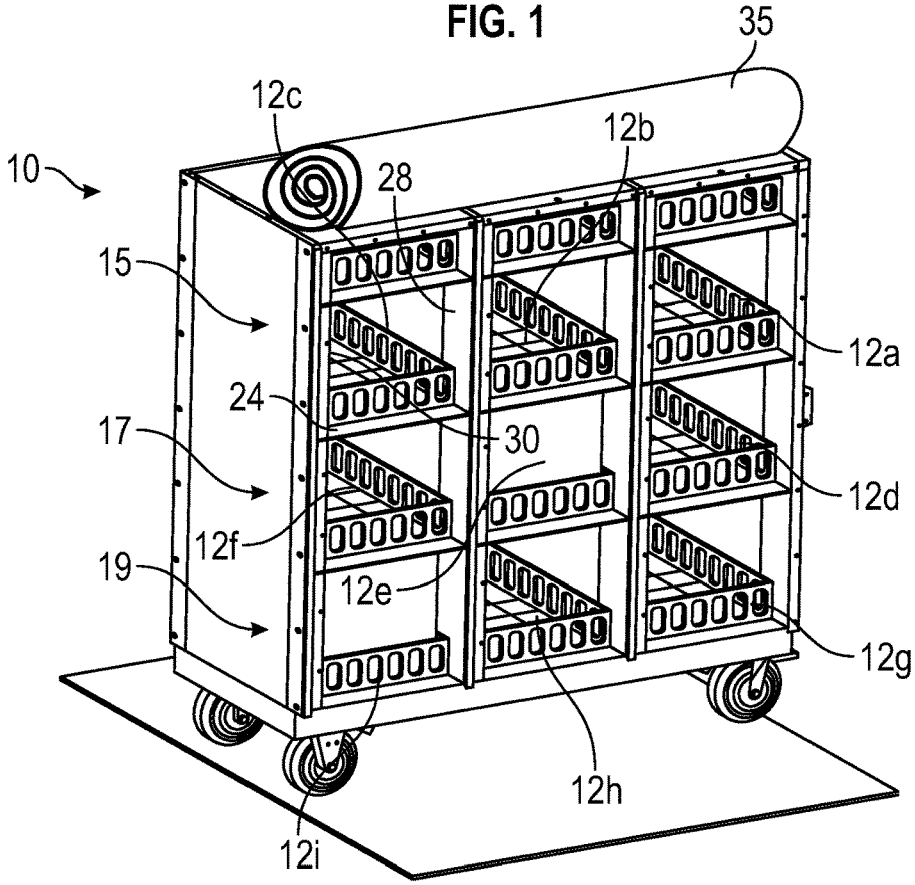
FIG. 2 is a rear perspective view of the cabinet of FIG. 1, in accordance with a non-limiting example.
Figure 3:
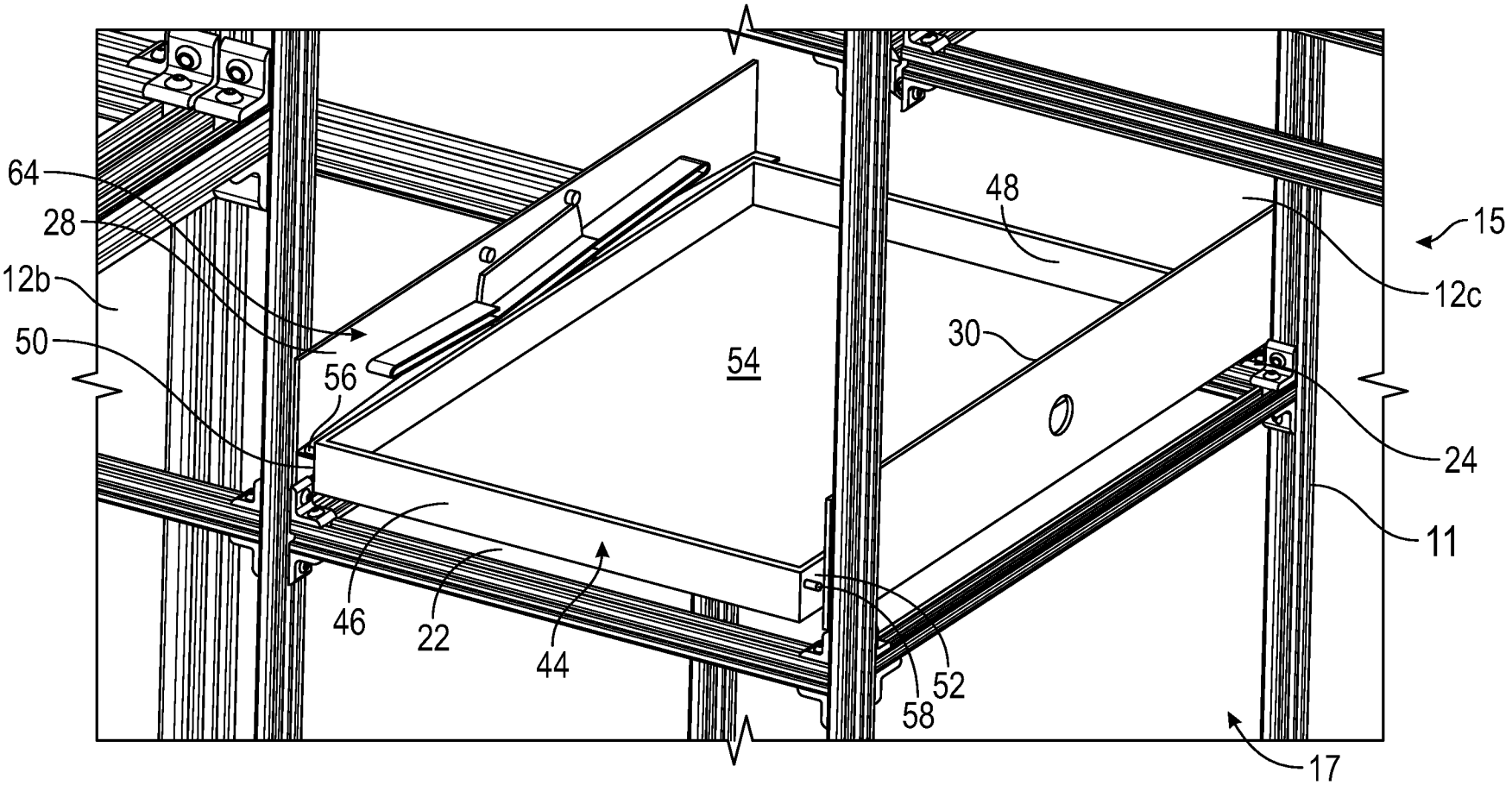
FIG. 3 is a schematic view of a shelf member supported by the bi-directional slide and tilt mechanism, in accordance with a non-limiting example.
Figure 4:
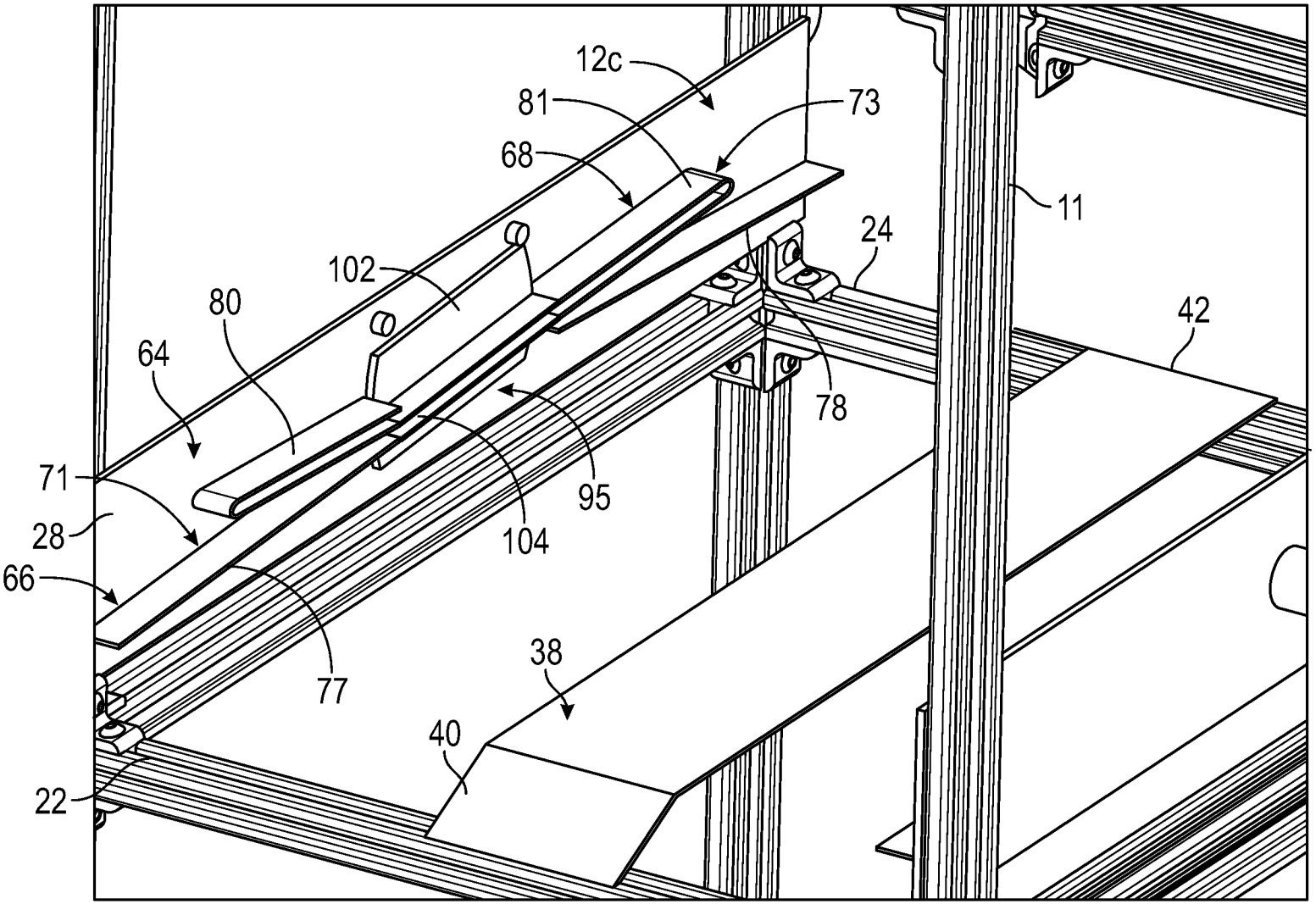
FIG. 4 is a schematic view of the bi-directional slide and tilt mechanism of FIG. 3 without the shelf member, in accordance with a non-limiting example.

A cabinet, in accordance with a non-limiting example, is indicated generally at 10 in FIG. 1. Cabinet 10 includes support frame 11 (FIG. 3) that defines a plurality of product receiving zones 12*a*-12*i* arranged in a first or uppermost row 15, a second or middle row 17, and a third or bottom row 19. Reference will now follow to FIGS. 2-4 and with continued reference to FIG. 1 in describing product receiving zone 12*c* with an understanding that product receiving zones 12*a* and 12*b* include similar structure.

In accordance with a non-limiting example, product receiving zone 12*c* includes a first or product delivery end 22 and a second, or product loading end 24 that is opposite to first end 22. Product receiving zone 12*c* also includes a first side 28 and a second side 30. First and second sides 28 and 30 extend between first end 22 and second end 24. Product receiving zone 12 includes a door 32 at first end 22. Cabinet 10 includes a cover 35 (FIG. 2) that closes the second end 24 of each of the product receiving zones 12*a*-12*i*. Cover 35 may be opened exposing all of product receiving zones 12*a*-12*i* to allow cabinet 10 to be loaded with products. Products may then be retrieved by individuals authorized to open, for example, a door 32. In a non-limiting example, product receiving zone 12*c* includes an angle control bar 38 (FIG. 4) that extends from first end 22 to second end 24 between first side 28 and second side 30. Angle control bar 38 includes a first angled support surface 40 at first end 22 and a second angled support surface 42 at second end 24.

In a non-limiting example, product receiving zone 12*c* includes a shelf member 44 that supports, for example, one or more products. In a non-limiting example, shelf member 44 is bi-directional. That is, shelf member 44 may slide outwardly from and tilt downwardly relative to first end 22 to promote delivery of products and may also slide outwardly from and tilt downwardly relative to, second end 24. When extending outwardly of first end 22, shelf member 44 may rest on, for example, first angled support surface 40 to promote retrieval and/or loading of products as will be detailed more fully herein. Similarly, when extending outwardly of second end 24, shelf member 44 may rest on second angled support surface 42.

Figure 5:
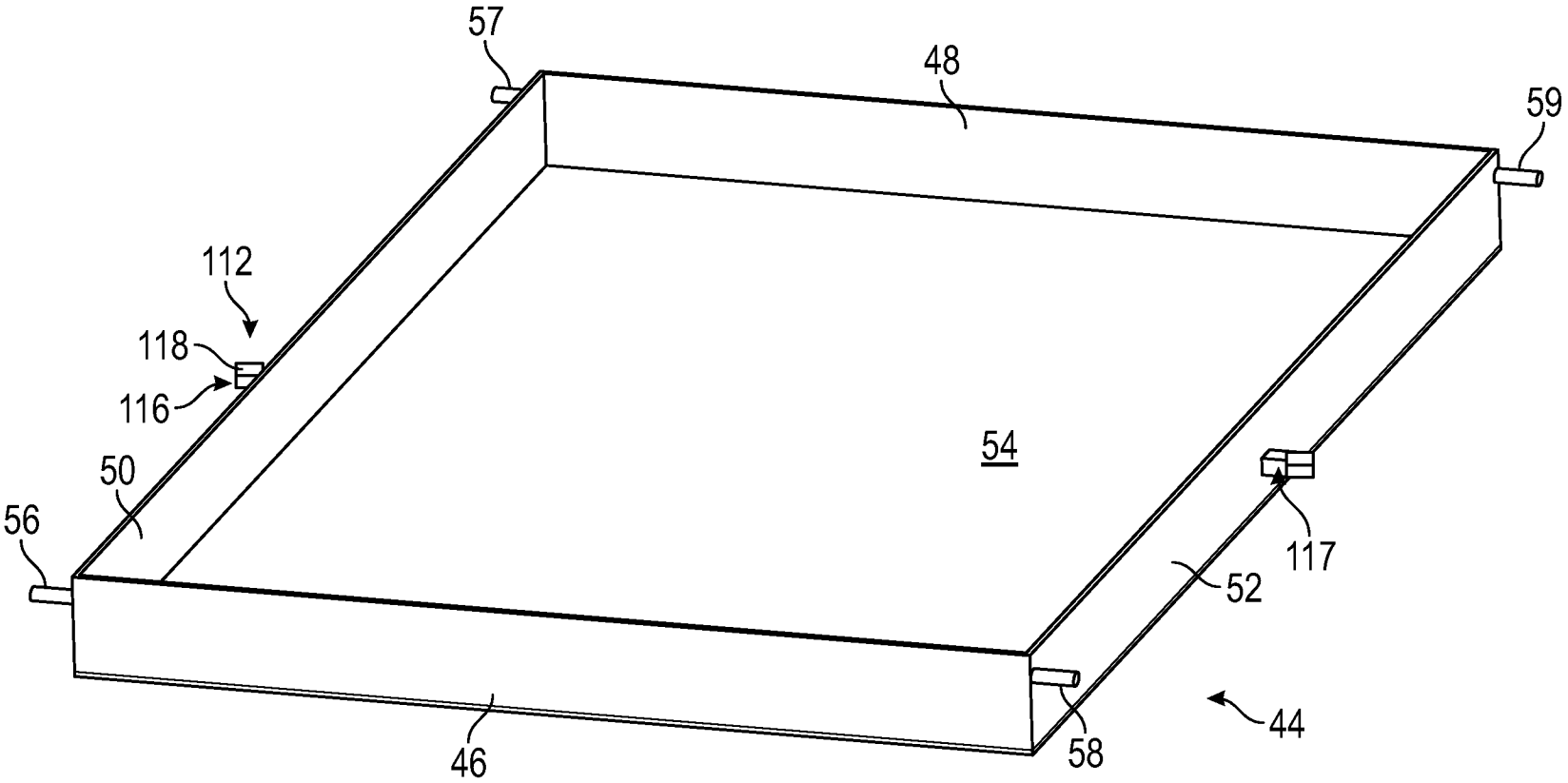
FIG. 5 is a perspective view of the shelf member of FIG. 3, in accordance with a non-limiting example.

As shown in FIGS. 3 and 5, shelf member 44 includes a first end portion 46 and a second end portion 48. Second end portion 48 is opposite to first end portion 46. Shelf member 44 also includes a first side portion 50 and a second side portion 52. Second side portion 52 is opposite to first side portion 50. First and second side portions 50 and 52 extend between first end portion 46 and second end portion 48. Shelf member 44 also includes a base or article support surface 54. In a non-limiting example, first side portion 50 includes a first shelf support 56 arranged near first end portion 46 and a second shelf support 57 arranged near second end portion 48. Similarly, second side portion 52 includes a third shelf support 58 arranged near first end portion 46 and a fourth shelf support 59 arranged near second end portion 48.

Figure 6:
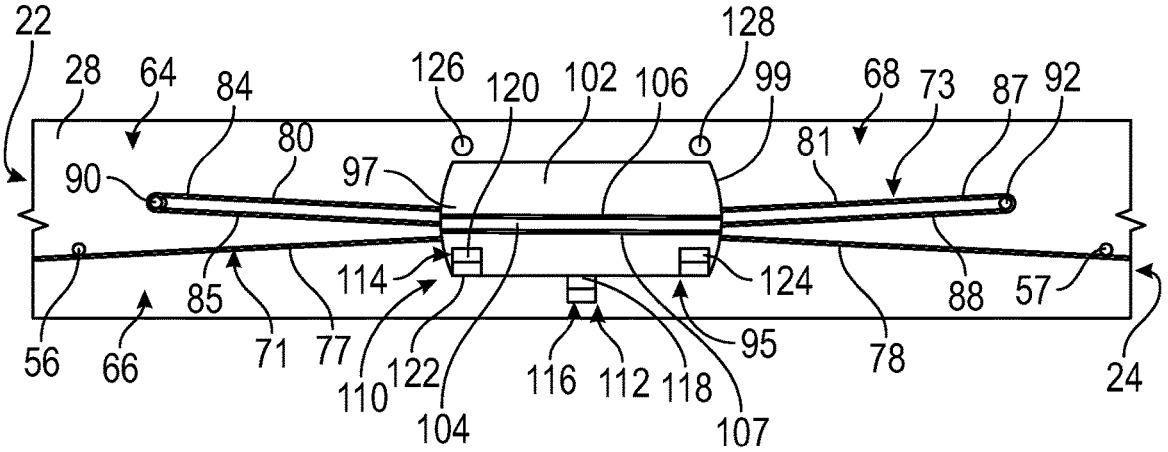
FIG. 6 is a plan view of a switch member of the bi-directional slide and tilt mechanism of FIG. 3 in a neutral position, in accordance with a non-limiting example.
Figure 7:
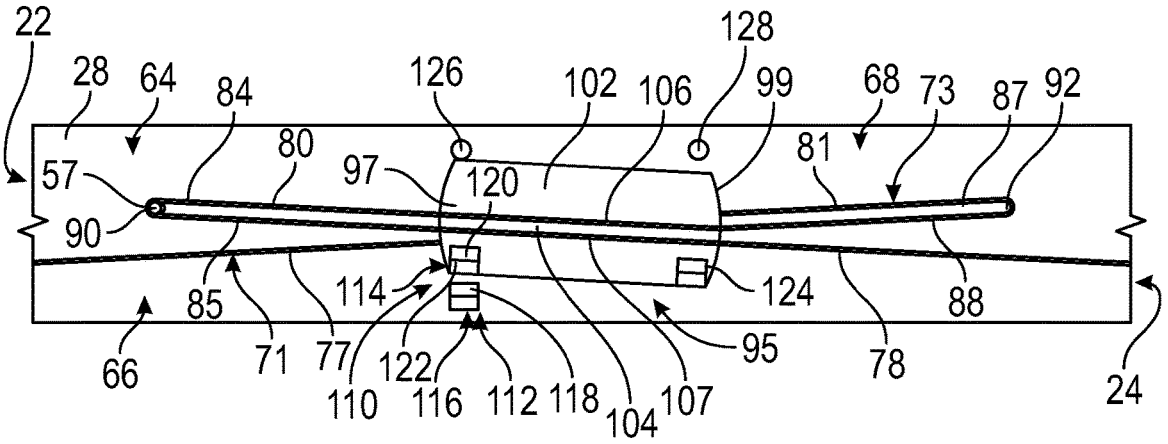
FIG. 7 is a plan view of a switch member of the bi-directional slide and tilt mechanism in a first configuration, in accordance with a non-limiting example.
Figure 8:
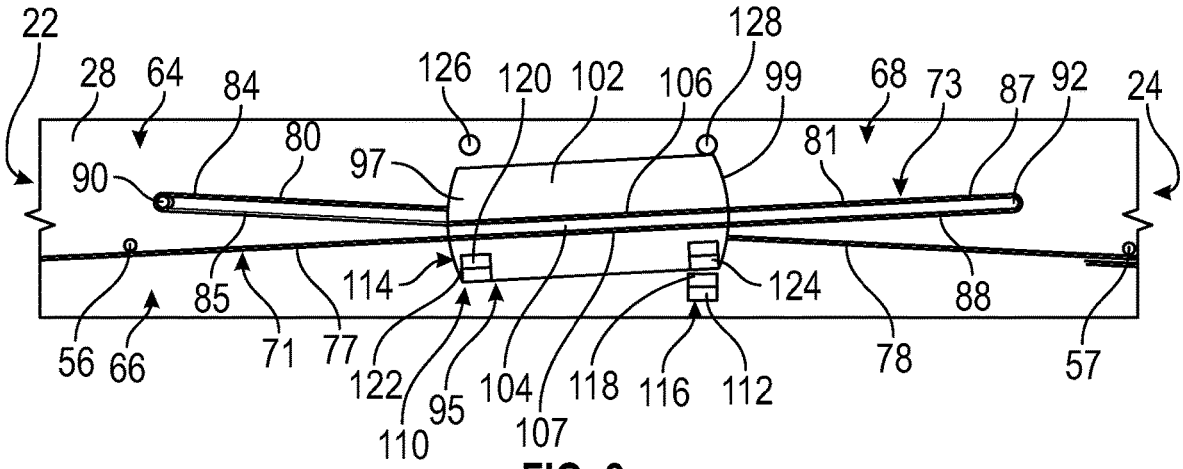
FIG. 8 is a plan view of a switch member of the bi-directional slide and tilt mechanism of FIG. 3 in a second configuration, in accordance with a non-limiting example.
Figure 9:
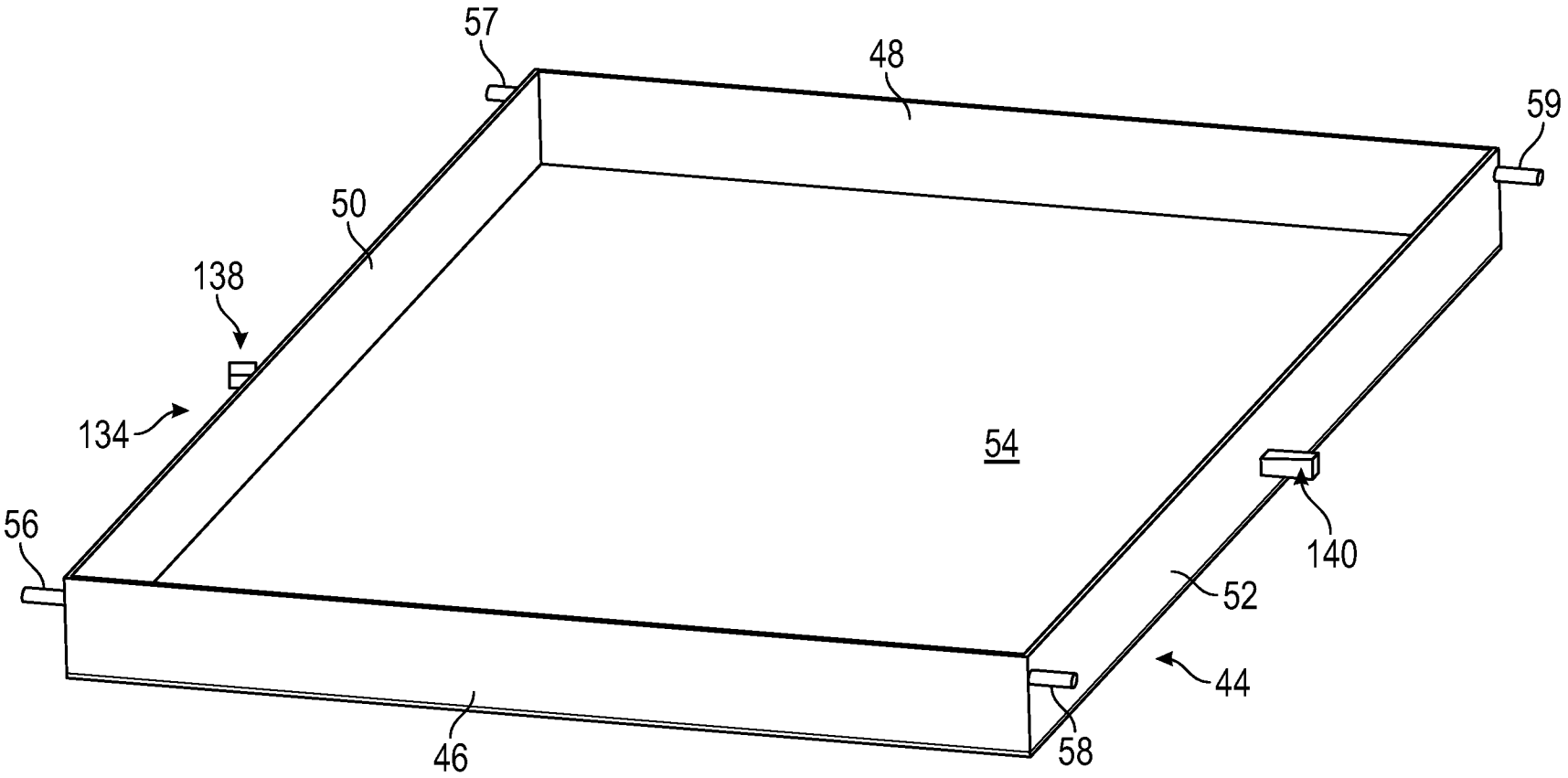
FIG. 9 is a perspective view of a shelf member for a bi-directional slide and tilt mechanism, in accordance with another non-limiting example.

In a non-limiting example, cabinet 10 includes a bi-directional slide and tilt mechanism 64 that facilitates the sliding and tilting of shelf member 44 from each of first end 22 and second end 24 of product receiving zone 12*c*. Reference will now follow to FIGS. 6-8 with continued reference to FIG. 4 in describing bi-directional slide and tilt mechanism 64 in accordance with a non-limiting example. Bi-directional side and tilt mechanism 64 is mounted to first side 28. It should be understood that another bi-directional slide and tilt mechanism (not shown) is mounted to second side 30.

In accordance with a non-limiting example, bi-directional slide and tilt mechanism 64 includes a first portion 66 receptive of the first shelf support 56 and second shelf support 57 when shelf member 44 is received by product receiving zone 12*c*, and a second portion 68 that is receptive of one of first shelf support 56 and second shelf support 57 when shelf member is slid out from and tilted downward from product receiving zone 12*c*. First portion 66 includes a first track 71 and second portion 68 includes a second track 73. First and second tracks 71 and 73 are provided on first side 28. In a non-limiting example, first track 71 extends at a first angle relative to first side 28 and second track 73 extends at a second angle relative to first side 28. The first angle is distinct from the second angle.

In a non-limiting example, first track 71 includes a first section 77 and a second section 78. Second track 73 includes a third section 80 and a fourth section 81. Third section 80 includes a first track element 84 spaced from a second track element 85 forming a channel (not separately labeled). Similarly, fourth section 81 includes a third track element 87 spaced from a fourth track element 88 forming another channel (also not separately labeled). First track element 84 is joined to second track element 85 by a first end stop 90 adjacent to first end 22 and third track element 87 is joined to fourth track element 88 by a second end stop 92 adjacent to second end 24.

In accordance with a non-limiting example, bi-directional slide and tilt mechanism 64 includes a switch member 95 pivotally mounted to first side 28. Switch member 95 is positioned between first section 77 and second section 78 of first track 71 and third section 80 and fourth section 81 of second track 73. Switch member 95 includes a first end section 97, a second end section 99, and an outer surface 102 extends between first end section 97 and second end section 99.

In a non-limiting example, outer surface 102 supports a guide channel 104 defined by a first rail 106 and a second rail 107. Second rail 107 runs substantially parallel to and is spaced from first rail 106. The spacing between first rail 106 and second rail 107 is the same or substantially similar to the spacing between first track element 84 and second track element 85, and third track element 87 and fourth track element 88. As will be detailed herein, switch member 95 is pivotable such that guide channel 104 selectively bridges between second section 78 of first track 71 and third section 80 of second track 73 as shown in FIG. 7 and between first section 77 of first track 71 and fourth section 81 of second track 73 as shown in FIG. 8 when shelf member 44 is transitioned out from product receiving zone 12*c*.

In a non-limiting example, bi-directional slide and tilt mechanism 64 includes an activation mechanism 110 that causes switch member 95 to rotate such that guide channel 104 selectively connects first section 77 with fourth section 81 and second section 78 with third section 80. In a non-limiting example, activation mechanism 110 includes a first portion 112 provided on shelf member 44 and a second portion 114 provided on switch member 95. First portion 112 includes a first member 116 mounted to first side portion 50 and a second member 117 mounted to second side portion 52. First member 116 interacts with switch member 95 while second member 117 interacts with a switch member (not shown) provided on second side 30. In a non-limiting example, first member 116 includes a first magnet 118 and switch member 95 supports a second magnet 120 that takes the form of a first magnet element 122 arranged at first end section 97 and a second magnet element 124 arranged at second end section 99.

In a non-limiting example, when shelf member 44 resides within product receiving zone 12*c*, switch member 95 is in a neutral position as shown in FIG. 6. In the neutral position, first magnet 118 does not interact with first magnet element 122 and second magnet element 124. Further first shelf support 56 rests upon first section 77 of first track 71 and second shelf support 57 rests on second section 78 of first track 71. As shelf member 44 transitions toward first end 22, first magnet 118 aligns with and repels first magnet element 122 causing switch member 95 to rotate as shown in FIG. 7 such that such that guide channel 104 bridges between second section 78 of first track 71 and third section 80 of second track 73. Rotation of switch member 95 is constrained by a stop 126.

Shelf member 44 continues to slide such that first shelf support 56 transitions off of first section 77 of first track 71 and second shelf support 57 passes into third section 80. With first shelf support 56 no longer being supported by first section 77, shelf member 44 tilts downward as shown in FIG. 1. Continued sliding causes second shelf support 57 to contact first end stop 90 to prevent further movement. In this position, shelf member 44 rests upon first angled support surface 40 of angle control bar 38. Tilted downward, shelf member 44 is more easily accessible. Similarly, shelf member 44 may transition from the neutral position (FIG. 6) toward second end 24 such that first magnet 118 repels second magnet element 124 causing switch member 95 to connect first section 77 with fourth section 81. Rotation of switch member 95 is constrained by a stop 128. At this point shelf member 44 may be withdrawn from second end 24 and tilted downwardly to facilitate loading.

Reference will now follow to FIGS. 9-13, wherein like reference numbers represent corresponding parts, in the respective views, in describing an activation system 129 in accordance with another non-limiting example. Activation system 129 includes a first portion 134 provided in shelf member 44, FIG. 8, and a second portion 136 provided on switch member 95. In a non-limiting example, first portion 134 includes a first cam member 138 provided on first side portion 50 of shelf member 44 and a second cam member 140 provided on second side portion 52 of shelf member 44. As will be detailed herein, first cam member 138 interacts with switch member 95 provided on first side 28 and second cam member 140 interacts with a second switch member (not shown) provided on second side 30.

In a non-limiting example, second portion 136 includes a first cam surface 142 and a second cam surface 144 formed on switch member 95. First cam surface 142 and second cam surface 144 meet at a point 146 defined within switch member 95. First cam surface 142 extends at a first cam angle from point 146 toward first end section 97 and second cam surface 144 extends at a second cam angle from point 146 toward second end section 99. The second cam angle is substantially the same as the first cam angle.

Figure 10:
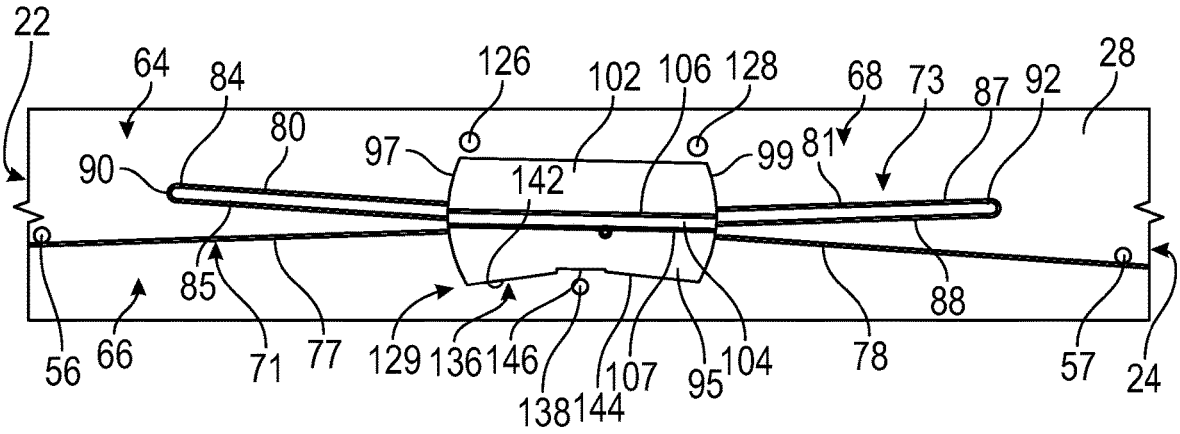
FIG. 10 is a plan view of a switch member in a neutral position, in accordance with the another non-limiting example.

In a non-limiting example, when shelf member 44 resides within product receiving zone 12*c*, switch member 95 is in a neutral position as shown in FIG. 10 with first cam member 138 being positioned below point 146. In the neutral position, first shelf support 56 rests upon first section 77 of first track 71 and second shelf support 57 rests on second section 78 of first track 71. As shelf member 44 transitions toward first end 22, first cam member 138 acts upon first cam surface 142 causing switch member 95 to rotate as shown in FIG. 11 such that guide channel 104 connects second section 78 of first track 71 with third section 80 of second track 73.

Figure 11:
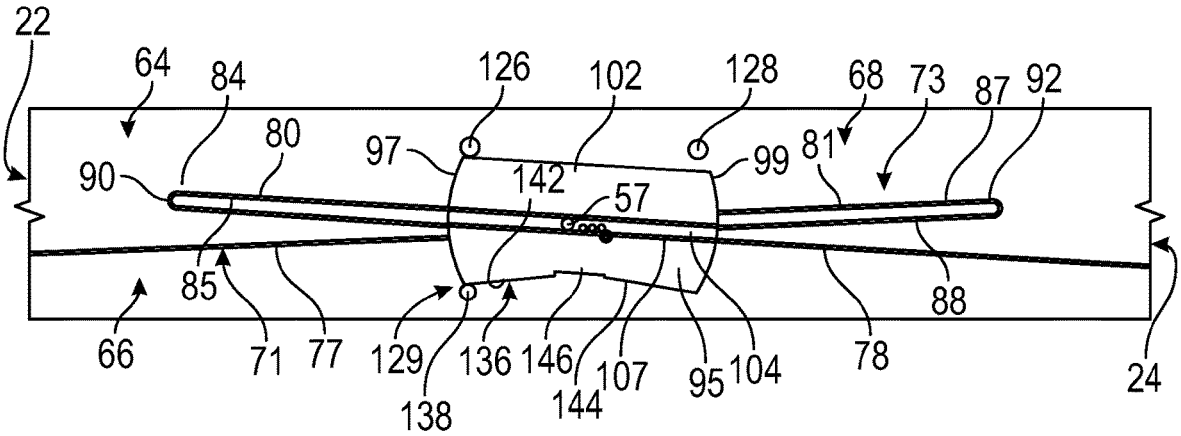
FIG. 11 is a plan view of a switch member in a first configuration position, in accordance with the another non-limiting example.
Figure 12:
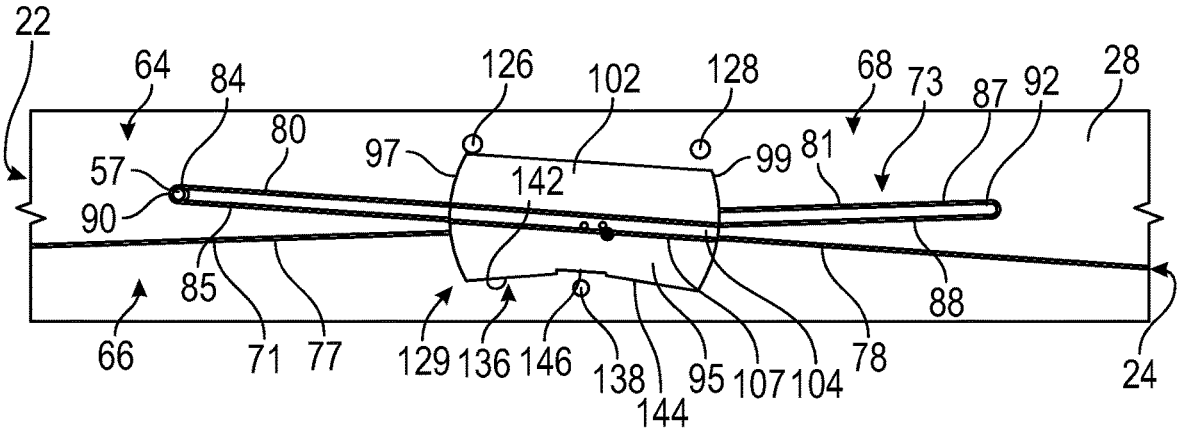
FIG. 12 depicts the shelf member shifting toward a first end of the cabinet, in accordance with the another non-limiting example.
Figure 13:
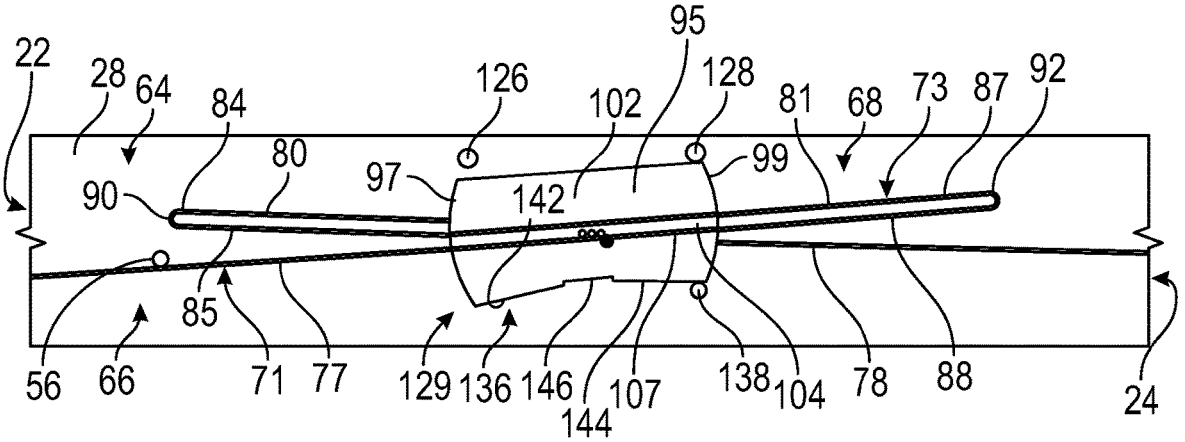
FIG. 13 is a plan view of a switch member in a second configuration, in accordance with the another non-limiting example.

Shelf member 44 continues to slide such that first shelf support 56 transitions from first section 77 of first track 71 and second shelf support 57 passes through guide channel 104 as shown in FIGS. 11 and 12 into third section 80. With first shelf support 56 no longer being supported by first section 77, shelf member 44 tilts downward as shown in FIG. 1. Continued sliding causes second shelf support 57 to contact first end stop 90 to prevent further movement. In this position, shelf member 44 rests upon first angled support surface 40 of angle control bar 38. Tilted downward, shelf member 44 is more easily accessible. Similarly, shelf member 44 may transition from the neutral position (FIG. 10) toward second end 24 such that first cam member 138 acts upon second cam surface 144 as shown in FIG. 13 causing switch member 95 to pivot such that guide channel 104 connects first section 77 with fourth section 81. At this point shelf member 44 may be withdrawn from second end 24 and tilted downwardly to rest on second angled support surface 42 to facilitate loading.

Figure 14:
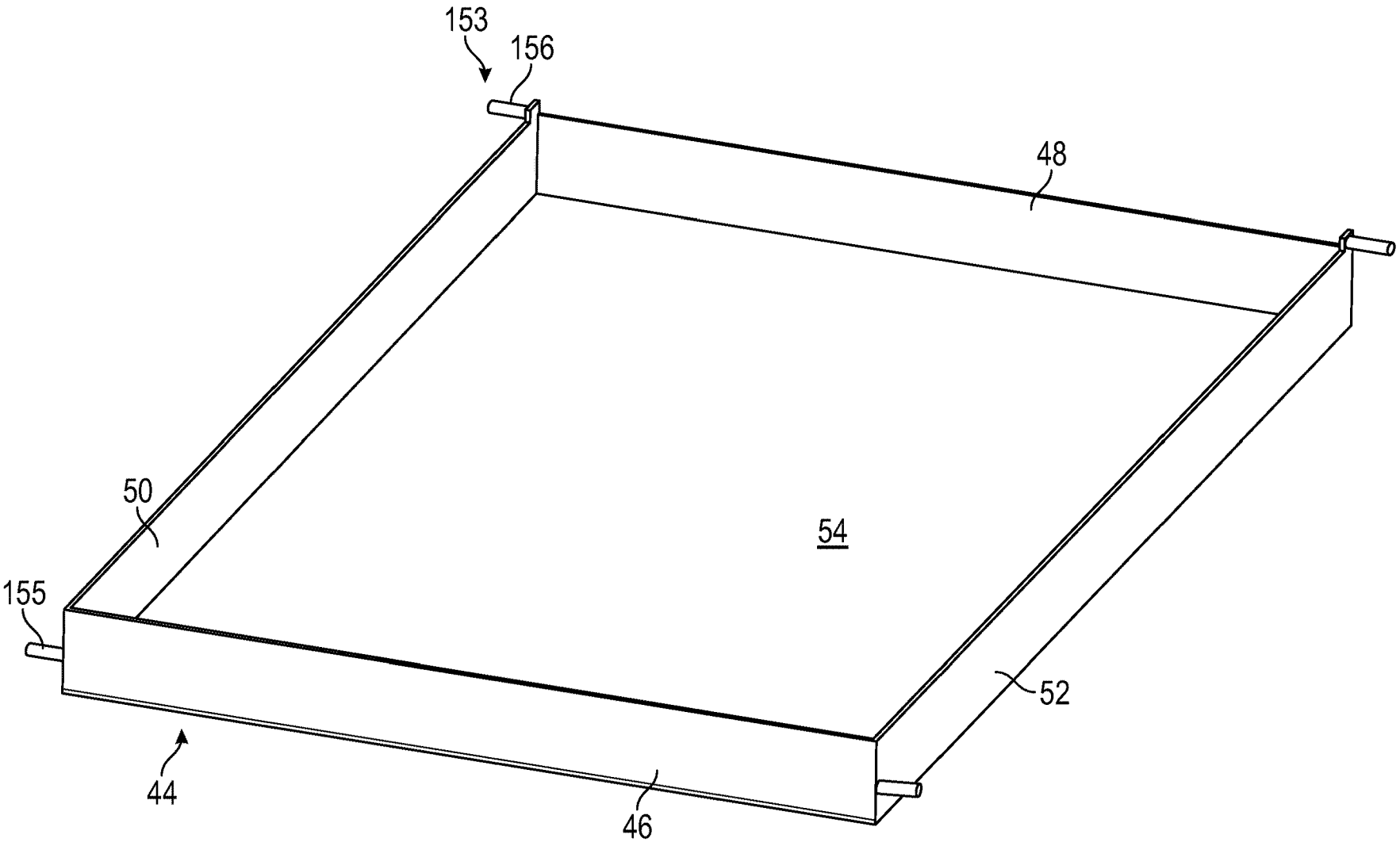
FIG. 14 is a perspective view of a shelf member, in accordance with yet another non-limiting example.
Figure 15:
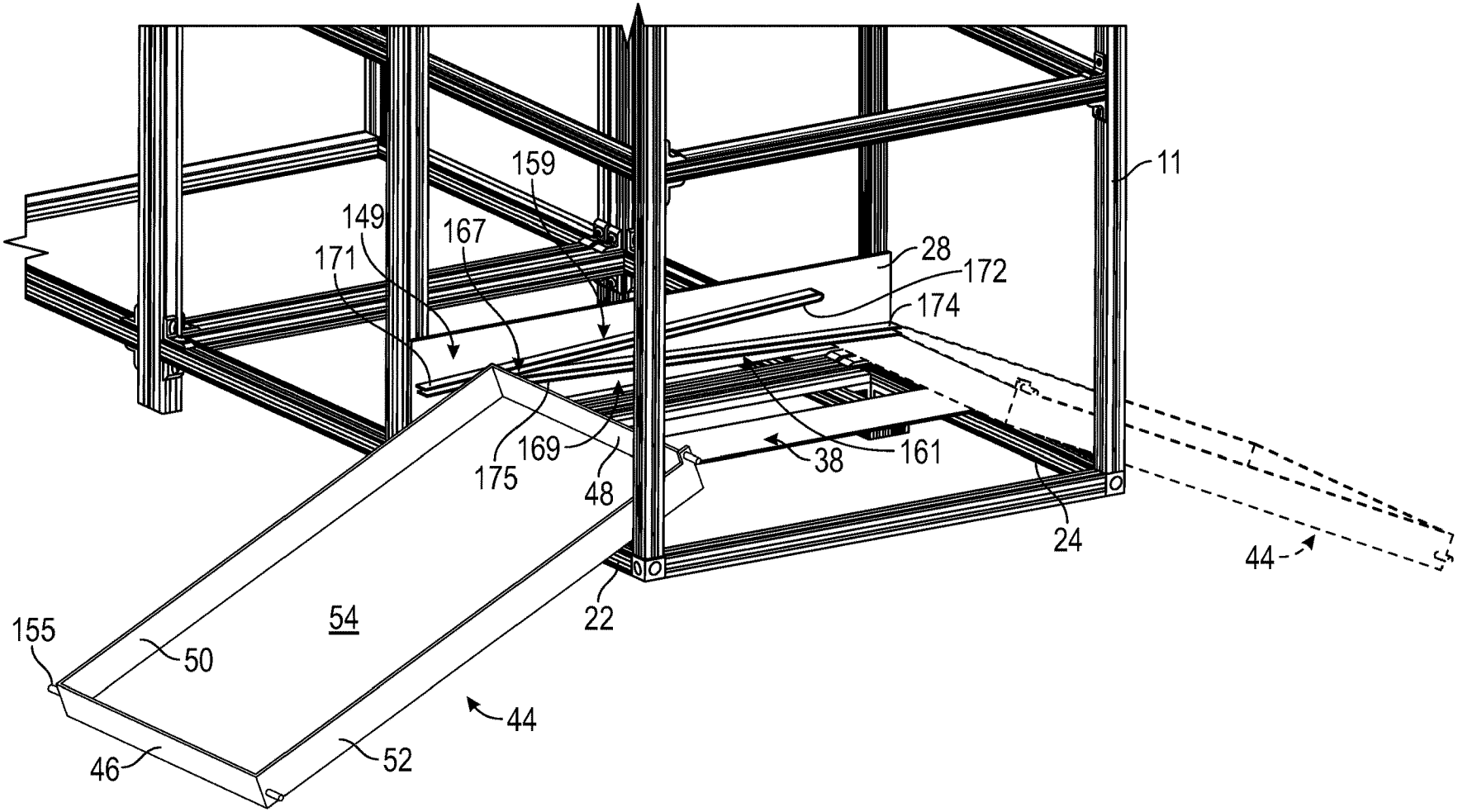
FIG. 15 is a schematic view of a bi-directional slide and tilt mechanism, in accordance with the yet another non-limiting example.

Reference will now follow to FIGS. 14 and 15 in describing a passive bi-directional slide and tilt mechanism 149 in accordance with another non-limiting example. By passive, it should be understood that bi-directional slide and tilt mechanism 149 facilitates sliding and tilting without the need for a switch member. In a non-limiting example, bi-directional slide and tilt mechanism 149 includes a first portion 153 provided on shelf member 44.

First portion 153 includes a first shelf support member 155 arranged adjacent to a lower edge of first side portion 50 at first end portion 46 and a second shelf support member 156 arranged adjacent to an upper edge of first side portion 50 at second end portion 48. Thus, first and second shelf support members 155 and 156 are spaced from one another along two axes. A first axis that defines a length of shelf member 44 and a second axis that defines a height of shelf member 44. It should be understood that additional, similarly arranged shelf support members are provided on second side portion 52.

In accordance with a non-limiting example, bi-directional slide and tilt mechanism 149 includes a second portion 159 provided on first side 28 as shown in FIG. 15. Second portion 159 takes the form of a two track system 161 including a first track 167 and a second track 169. First track 167 includes a first end 171 and a second end 172 having an end stop (not shown). Second end 172 is opposite to first end 171. Second track 169 includes a first end 174 and a second end 175 having an end stop (also not shown). Second end 175 is opposite to first end 174.

In a non-limiting example, first end 171 of first track 167 is arranged proximate to first end 22 and second end 172 of first track 167 is spaced from second end 24. First end 171 of first track 167 is lower than second end 172 of first track 167. In a non-limiting example, first end 174 of second track 169 is arranged proximate to second end 24 and second end 175 of second track 169 is spaced from first end 22. Further, first end 174 of second track 169 is lower than second end 175 of second track 169. At this point it should be understood that second side 30 includes similar first and second tracks (not shown).

In a non-limiting example, first shelf support 155 is arranged in first track 167 and second shelf support 156 is arranged in second track 169. In a non-limiting example, as shelf member 44 transitions from first end 22 of cabinet 10, first shelf support 155 releases from first track 165. Shelf member 44 continues to move outward until second shelf support 156 engages the end stop at second end 175 of second track 169. At this point, shelf member 44 may tilt downwardly and rest on first angled support surface 40 of angle control bar 38 as shown in FIG. 15.

Similarly, as shelf member 44 transitions from second end 24 of cabinet 10, second shelf support 156 releases from second track 169. Shelf member 44 continues to move outward until first shelf support 155 engages the end stop at second end 172 of first track 167. At this point, shelf member 44 may tilt downwardly and rest on first angled support surface 40 of angle control bar 38 as shown in FIG. 15. With this arrangement, shelf member 44 may be more readily accessed from either side of cabinet 10.

Figure 16:
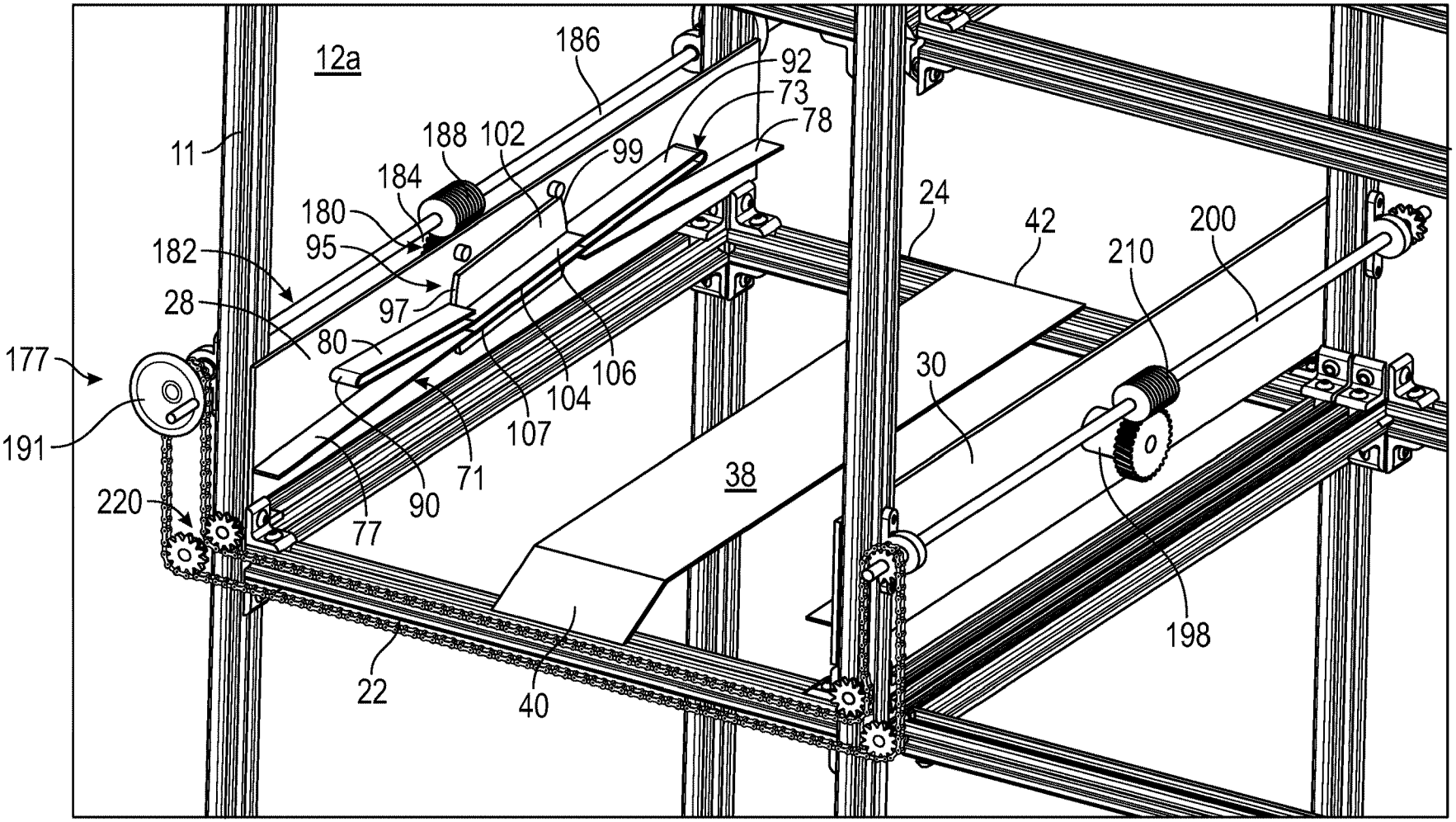
FIG. 16 is a schematic view of a bi-directional slide and tilt mechanism in a second configuration, in accordance with still yet another non-limiting example.
Figure 17:
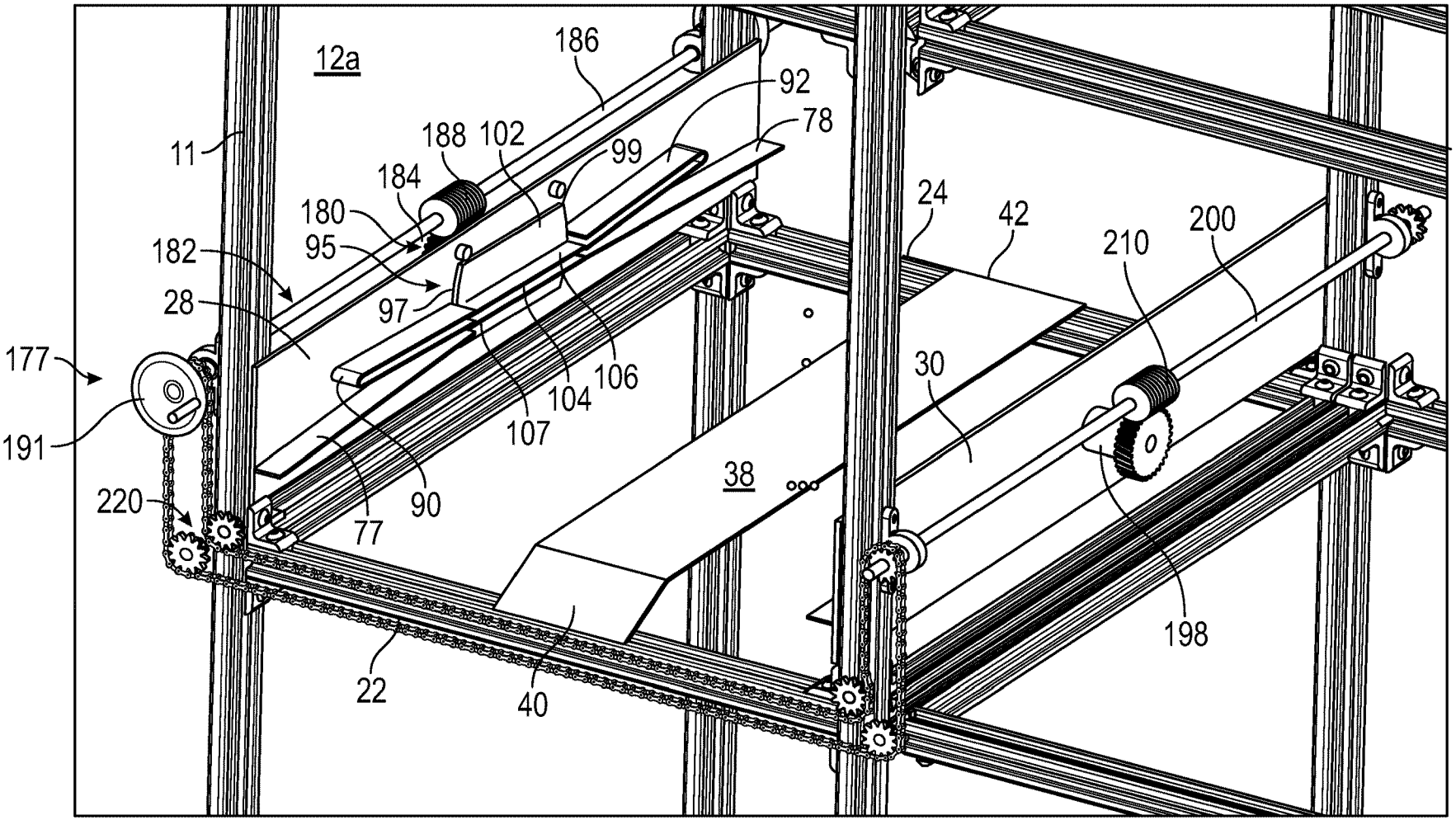
FIG. 17 is a schematic view of a bi-directional slide and tilt mechanism in a first configuration, in accordance with the still yet another non-limiting example.
Figure 18:
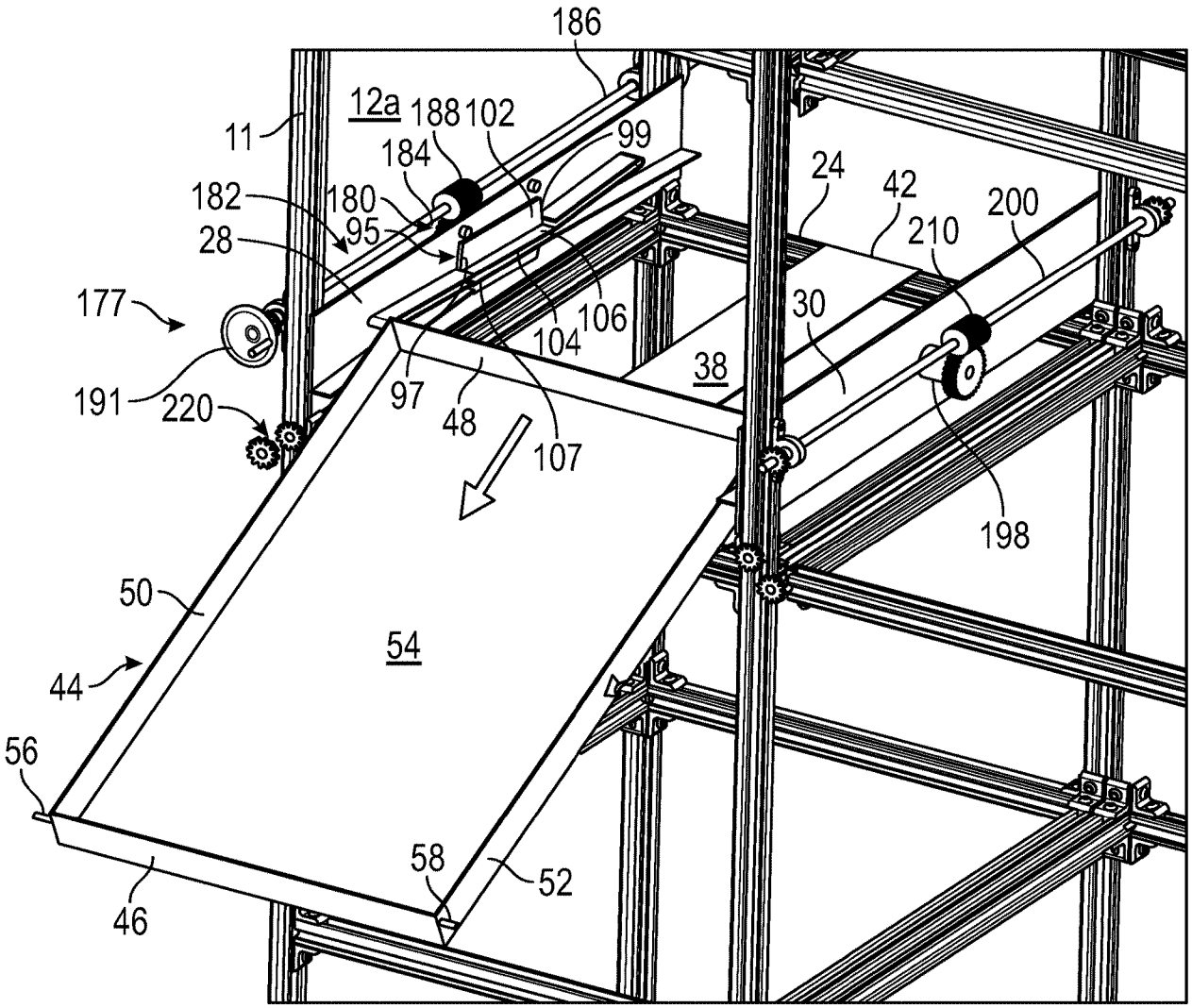
FIG. 18 is a schematic view of a bi-directional slide and tilt mechanism of FIG. 17 depicting a shelf member in a tilt position, in accordance with the still yet another non-limiting example.

Reference will now follow to FIGS. 16-18 in describing an activation system 177 that operates to transition switch member 95 between a forward slide/tilt position and a rearward slide/tile position. In a non-limiting example, activation system 177 includes a first portion 180 mounted to first side 28 and connected to switch member 95 and a second portion 182 supported by support frame 11 between first end 22 and second end 24. First portion 180 includes a gear 184 that is operatively connected to switch member 95. Thus, movement of gear 184 is directly transferred to switch member 95 as will be discussed herein.

In a non-limiting example, second portion 182 includes an axle 186 coupled to support frame 11 and extending between first end 22 and second end 24 of cabinet 10. Axle 186 supports a worm gear 188 that is operatively connected to gear 184. Axle 186 also supports a hand wheel 191 which, when rotated shifts switch member 95. In a non-limiting example, activation system 177 includes another gear 198 coupled to a switch member (not shown) on second side 30. Another axle 200 extends between first end 22 and second end 24 at second side 30. The another axle 200 supports another worm gear 210 that is operatively connected to the another gear 198. Axle 186 is operatively connected to the another axle 200 through a chain and sprocket system 220.

With this arrangement, operation of hand wheel 191 activates switch member 95 on first side 26 and the switch member (not shown) on second side 30. Further, hand wheel 191 can be set up to simultaneously operate switch members in each of product receiving zones 12*a*-12*c* in first row 15.

In a non-limiting example, hand wheel 191 may be rotated to set switch member 95 such that guide channel 104 connects second section 78 of first track 71 with third section 80 of second track 73 to promote withdrawal of shelf member 44 from first end 22. Shelf member 44 is withdrawn causing first shelf support 56 to transition from first section 77 of first track 71 and second shelf support 57 passes through guide channel 104 into third section 80. With first shelf support 56 no longer being supported by first section 77, shelf member 44 tilts downward as shown in FIG. 18. Continued sliding causes second shelf support 57 to contact first end stop 90 to prevent further movement. In this position, shelf member 44 rests upon first angled support surface 40 of angle control bar 38. Tilted downward, shelf member 44 is more easily accessible. Similarly, hand wheel may be operated causing switch member 95 to pivot such that guide channel 104 connects first section 77 with fourth section 81. Shelf member 44 may the transition from second end 24 and rested on second angles support surface 42 in a manner similar to that described herein.

At this point, it should be appreciated that the disclosed non-limiting examples describe various systems that facilitate the withdrawal and tilting of a shelf from opposite end of a cabinet. The various system include structure that supports the shelf in the tilted position and also contains further outward movement when tilted. The sliding and tilting of the shelf facilitates loading and removal of goods particularly from shelves arranged in a top portion of the cabinet. Also, in addition to the mechanical systems described herein, a bi-directional slide and tilt mechanism that includes an electrical activation system is also contemplated.

While the above disclosure has been described with reference to exemplary embodiments, it will be understood by those skilled in the art that various changes may be made and equivalents may be substituted for elements thereof without departing from its scope. In addition, many modifications may be made to adapt a particular situation or material to the teachings of the disclosure without departing from the essential scope thereof. Therefore, it is intended that the present disclosure not be limited to the particular embodiments disclosed, but will include all embodiments falling within the scope thereof.

What is claimed is:

1. A shelving system comprising:

a cabinet including a product receiving zone, the product receiving zone including a first end, a second end that is opposite the first end, a first side and a second side that is opposite the first side, the first side and the second side extending between the first end and the second end;

a shelf member arranged between the first side and the second side, the shelf member including a first side portion and a second side portion, one of the first side portion and the second side portion including a first shelf support and a second shelf support; and a bi-directional slide and tilt system mounted to one of the first side and the second side of the product receiving zone, the bi-directional slide and tilt system including a first portion receptive of the first shelf support and a second portion receptive of the second shelf support, the first portion being separated from the second portion by a discontinuity; and a switch member pivotally mounted to the one of the first side and the second side in the discontinuity, the switch member selectively connecting the first portion and the second portion to facilitate sliding and tilting of the shelf relative to the product receiving zone.

2. The shelving system according to claim 1, wherein the first portion includes a first track extending at a first angle relative to the one of the first side and the second side and the second portion includes a second track that extends at a second angle relative to the one of the first side and the second side, the second angle being distinct from the first angle.

3. The shelving system according to claim 2, wherein the first track includes a first section extending toward the first end and a second section extending toward the second end, and the second track includes a third section extending toward the first end and a fourth section extending toward the second end.

4. The shelving system according to claim 3, wherein the switch member is selectively positionable in a first configuration connecting the first section of the first track with the fourth section of the second track and a second configuration connecting the second section of the first track with the third section of the second track.

5. The shelving system according to claim 4, further comprising an activation system that selectively shifts the switch member between the first configuration and the second configuration.

6. The shelving system according to claim 5, wherein the activation system includes a first portion mounted on the shelf member and a second portion mounted on the switch member.

7. The shelving system according to claim 6, wherein the first portion of the activation system includes a member projecting outwardly of the one of the first side portion and the second side portion between the first shelf support and the second shelf support.

8. The shelving system according to claim 7, wherein the member includes a first magnet, and the second portion of the activation system includes a second magnet.

9. The shelving system according to claim 8, wherein the second magnet includes a first magnet element arranged at a first end section of the switch member and a second magnet element arranged at a second end section of the switch member.

10. The shelving system according to claim 7, wherein the second portion of the activation system includes a first cam surface and a second cam surface.

11. The shelving system according to claim 10, wherein the first cam surface includes a first cam angle and the second cam surface includes a second cam angle.

12. The shelving system according to claim 11, wherein the first cam surface and the second cam surface meet at a point created by the first angle and the second angle.

13. The shelving system according to claim 5, wherein the activation system includes a first portion mounted to the one of the first side and the second side and operatively connected to the switch member and a second portion that extends between the first end and the second end at the one of the first side and the second side.

14. The shelving system according to claim 13, wherein the first portion is a first gear and the second portion is a second gear.

15. The shelving system according to claim 14, wherein the second gear is a worm gear.

16. The shelving system according to claim 1, further comprising an angle control bar extending between the first end and the second end below the shelf member.

17. The shelving system according to claim 16, wherein the shelf member is supported by only one of first shelf support and the second shelf support and the angle control bar when in a tilted configuration.

18. The shelving system according to claim 17, wherein the angle control bar limits tilting of the shelf member to a particular angle.

19. The shelving system according to claim 1, wherein the second portion of the bi-directional slide and tilt system includes an end stop.

20. The shelving system according to claim 1, wherein the second portion of the bi-directional slide and tilt system includes a first track element and a second track element spaced from the first track element, the one of the first shelf support and the second shelf support passing through the second portion is constrained between the first track element and the second track element.

* * * * *